US006997745B2

(12) United States Patent
Ikeda

(10) Patent No.: US 6,997,745 B2
(45) Date of Patent: Feb. 14, 2006

(54) COAXIAL ELECTRICAL CONNECTOR

(75) Inventor: Kazuhiko Ikeda, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/007,274

(22) Filed: Dec. 9, 2004

(65) Prior Publication Data

US 2005/0136701 A1 Jun. 23, 2005

(30) Foreign Application Priority Data

Dec. 19, 2003 (JP) ..... 2003-423064

(51) Int. Cl.
*H01R 9/05* (2006.01)

(52) U.S. Cl. ..... 439/582; 439/63

(58) Field of Classification Search ..... 439/582, 439/578, 581, 585, 63, 394, 610
See application file for complete search history.

(56) References Cited

U.S. PATENT DOCUMENTS 5,662,480 A * 9/1997 Togashi ..... 439/63
5,772,470 A * 6/1998 Togashi ..... 439/582
5,879,190 A * 3/1999 Maruyama et al. ..... 439/582
6,361,383 B1 3/2002 Ko
6,416,357 B1 7/2002 Ko
6,447,335 B1 * 9/2002 Ko ..... 439/585
6,508,668 B1 * 1/2003 Yamane ..... 439/582
6,648,653 B2 * 11/2003 Huang et al. ..... 439/63
6,712,645 B1 * 3/2004 Chou ..... 439/582
6,739,907 B2 * 5/2004 Kuroda et al. ..... 439/582
2003/0129858 A1 7/2003 Huang et al.

FOREIGN PATENT DOCUMENTS

JP 05-152037 6/1993
JP 2001-43939 2/2001

* cited by examiner

*Primary Examiner*—Hien Vu
(74) *Attorney, Agent, or Firm*—Takeuchi&Kubotera, LLP

(57) ABSTRACT

A coaxial electrical connector is comprised of an outer conductor (11) having a cylindrical fitting section (14) to fit onto a counter connector (60), a dielectric (12) placed in the outer conductor (11) and a center conductor (13) which is held by the dielectric (12). It further includes a cover section (16) to cover the other opened end of the cylindrical fitting section (14), a pair of arms (15) which extend in the radial direction from the cylindrical fitting section, and a surrounding section (17) to surround a cable C and the arms. Narrowing sections (15B) which have smaller distance from each other than the distance between the pair of arms (15) are provided at the boundary portion between the cylindrical fitting section (14) and the pair of arms (15).

8 Claims, 5 Drawing Sheets

COAXIAL ELECTRICAL CONNECTOR

BACKGROUND OF THE INVENTION

1. Field of the Invention

The present invention relates to a coaxial electrical connector, especially a right angle coaxial electrical connector.

2. Description of the Related Art

As for the right angle electrical connector, the one disclosed in JP 2001-43939 is known.

As shown in FIG. 4, the connector 50 of the Patent Reference is fitted and connected onto the counter connector 60, which is arranged on a circuit board P, in the direction vertical to the circuit board.

The counter connector 60 has a cylindrical outer conductor 61, a center conductor 62 arranged in the center of the outer conductor 61, and a dielectric 63 which is molded between those conductors as a unitary piece. The outer conductor 61 is formed to have a cylindrical shape by rolling and jointing two edges of a metal sheet piece. The outer conductor 61 has a locking groove 61A on the outer circumferential surface. The center conductor 62 has a rod-like contact section 62A, and a connecting section 62B which is formed as an L-shape arm extending from the lower end of the contact section 62A. The dielectric 63 is arranged only in lower portion of the counter connector 60. Above the dielectric 63, an annular receiving space is formed between the outer conductor 61 and the contact section 62A of the center conductor 62.

The outer conductor 51 of the connector 50 which is fitted and connected onto the counter connector 60 has a cylindrical fitting section 51A, a cover section 51B, a frame-like section 51C, and a surrounding section 51D. The outer conductor 51 is made by punching a metal sheet, and then bending it to form the shape. As also shown in FIG. 5, the cylindrical fitting section 51A has a jointing section 51A1 at its upper half portion, and has a cylindrical shape. An annular protrusion 51E for locking the fitting of the connectors is provided on the inner surface of the cylindrical fitting section 51A by making an annular groove on the outer surface of the cylindrical fitting section 51A. A plurality of slits 51F is provided at the lower half portion of the cylindrical fitting section 51A along its circumferential direction, so as to cross the annular protrusion 51E. The frame-like section 51C is provided so as to protrude in the radial direction of the fitting section 51A from a part of the upper portion of the fitting section 51A.

The outer conductor 51 holds the dielectric 52, while the dielectric 52 holds a terminal 53, which is a center conductor of the connector 50. As shown in FIG. 5, the cover section 51B and the surrounding section 51D of the outer conductor 51 are provided opposite the frame-like section 51C in the radial direction, and extend upward from a circumferential wall of the cylindrical fitting section 51A. After the dielectric 52 and the terminal 53 which is already connected to a cable are held in the cylindrical fitting section 51A, the cover section 51B and the surrounding section 51D are bent downward for 90 degree, as shown in FIG. 4. The cover section 51B and the cylindrical fitting section 51A are connected via a narrow linking section 51G, where the cover section 51B is bent. The dielectric 52 holds the terminal 53, and has a terminal hole 52A to house a spring contact section 53A of the terminal 53. The dielectric 52 also has a tongue 52B which can be bent upward at its base and a cable receiving section 52D having a cable guiding groove 52C.

In this connector 50, as shown in FIG. 5, after the core-wire C1 of the coaxial cable C is connected by soldering onto the upper surface of the terminal 53, the contact section 53A of the terminal 53 is inserted into the terminal hole 52A of the dielectric 52. Then, the outer conductor 51 is bent at the linking section 51G while pushing the tongue 52B of the dielectric 52 (See FIG. 4), and then the surrounding section 51D is bent so as to surround the frame-like section 51C and tightly hold the cable C.

Once the connector 50 is fitted onto the counter connector 60, the contact section 53A of the terminal of the connector 50 contacts with the center conductor 62 of the connector 60 by pinching it. While the cylindrical fitting section 51A of the outer conductor 51 of the connector 50 enlarges its diameter, it contacts with the outer circumferential surface of the outer conductor 61 of the connector 60, and the connector 50 is locked not to come off by the fitting of the annular protrusion 51E to the annular locking groove 61A.

In recent years, the size of electronic devices has been dramatically reduced, and electronic components used for a circuit board in such electronic device have been required to have a low profile. Especially in the right angle connector shown in FIGS. 4 and 5, the dimension of the connector 50 in the height direction, i.e. the dimension in the fitting direction, has to be reduced.

While the outer conductor 51 of the connector 50 has to have enough rigidity to maintain the shape of the cylindrical fitting section 51A, it also has to have enough elasticity to be capable of enlarging its diameter when the connector 50 is fitted to the counter connector 60. To satisfy those contrary requirements, as shown in FIG. 5, the cylindrical fitting section has the jointing section 51A1 at its upper half portion to maintain its cylindrical shape so as to have rigidity, and has slits at its lower half portion so as to have elasticity in the direction of enlarging the diameter. In other words, the cylindrical fitting section has to have upper and lower portions which have different functions, and therefore the dimension of the connector in the height direction has to be large.

SUMMARY OF THE INVENTION

In view of the above problems, it is an object of the invention to provide a coaxial electrical connector which has a lower profile while maintaining the rigidity to maintain its cylindrical shape and the elasticity to fit to the counter connector.

According to the invention there is provided a coaxial electrical connector has an outer conductor which has the cylindrical fitting section that has its axis in its fitting direction to the counter connector and is opened at one end for the fitting, a dielectric housed in and held by the cylindrical fitting section, and a center conductor that is held in the dielectric and has a contact section extending in the axial direction of the cylindrical fitting section. The outer conductor further comprises a cover section to cover the upper opened end of the cylindrical fitting section, a pair of arms extending from the cylindrical fitting section in the radial direction, and a surrounding section to surround the arms and a cable extending between the pair of arms in the radial direction of the cylindrical fitting section. The cover section and the surrounding section are formed by bending at the linking section the portion that extends upward in the axial direction of the cylindrical fitting section from a part of the upper opened end of the cylindrical fitting section.

The connector of this invention is featured by narrowing sections formed at the boundary portion between the cylindrical fitting section and the pair of arms, and the distance between those narrowing sections is set smaller than that between the pair of arms.

According to this invention, the rigidity to maintain the shape of the cylindrical fitting section of the outer conductor when it is in use, and the elasticity to enlarge the diameter of the cylindrical fitting section so as to fit to the counter connector can be achieved by providing the above-described narrow sections.

Conventionally, as in the connector disclosed in the Patent Reference, the rigidity to maintain the shape of the fitting section has been achieved by forming a perfect cylindrical shape by providing the jointing section at the upper half portion of the fitting section. In this case, however, since the rigidity is too large to achieve satisfactory elasticity to enlarge the diameter of the fitting section, slits have to be formed at the lower half portion. Accordingly, the fitting section has to have two different functioning portions in the height direction to achieve two different properties, and therefore, the outer conductor has to have a high profile.

The narrow sections are provided in this invention, and the rigidity achieved by those narrow sections is smaller than when the jointing section is formed. However, the elasticity for enlarging the diameter can be achieved without forming the slits while securing enough rigidity to maintain the shape of the fitting section. Therefore, without providing two different functioning portions in the height direction, the rigidity and the elasticity can be achieved simply by forming the narrowing sections, and therefore the size of the connector in the height direction can be reduced.

In the invention as described above, the cylindrical fitting section has a locking section on the inner circumferential surface to lock the fitting of the connectors. This locking section can be formed so as to extend to the arms in the axial direction of the fitting section, so that the dimension in the height direction can be reduced. In case of conventional connectors, the locking section has had to be formed at the lower portion of the fitting section while the arms has had to be formed at the upper portion, so that the dimension in the height direction has had to be large also because of this locking section.

The locking section of the cylindrical fitting section can be formed as an annular protrusion. In addition, the cylindrical fitting section can have a slit as necessary, which is opened at one end of the fitting section, and crosses the locking section in the axial direction of the cylindrical fitting section. With this constitution, the elasticity of the cylindrical fitting section can be enhanced.

In this invention, the surrounding section can be extended to the range of the narrowing sections in the extending direction of the cable. By doing this, the surrounding section can surround larger portion in the extending direction, and therefore it can hold the portion more securely. In addition, since the surrounding section does not contact with the narrowing sections, the elastic displacement of the cylindrical fitting section at the time of enlarging the diameter will not be adversely affected.

Preferably, the narrowing sections are formed so as to extend straight toward the fitting section and then have a curve. With this constitution, the cylindrical fitting section can maintain its circular cylindrical shape even at the narrowing sections even at the time of enlarging the diameter.

Moreover, in this invention, the dielectric preferably has a cable receiving section that extends in the radial direction of the cylindrical fitting section and is arranged between the pair of arms, and a latching section, whereby the cable receiving section and the arms latch each other and their engagement is reinforced.

As described above, in the present invention, the narrowing sections, which are disposed smaller distance away from each other than the distance between the pair of arms, are provided at the boundary portion between the cylindrical fitting section of the outer conductor and the pair of arms. Therefore, the elasticity sufficient for fitting the connector to the counter connector can be achieved while maintaining the rigidity sufficient to maintain the shape of the cylindrical fitting section. In addition, since the elasticity and the rigidity can be achieved simply by the narrowing sections, the connector can have a lower profile.

DESCRIPTION OF THE PREFERRED EMBODIMENTS

Referring now to the accompanied drawings FIGS. 1–3, an embodiment of this invention will be described.

Figure 2:
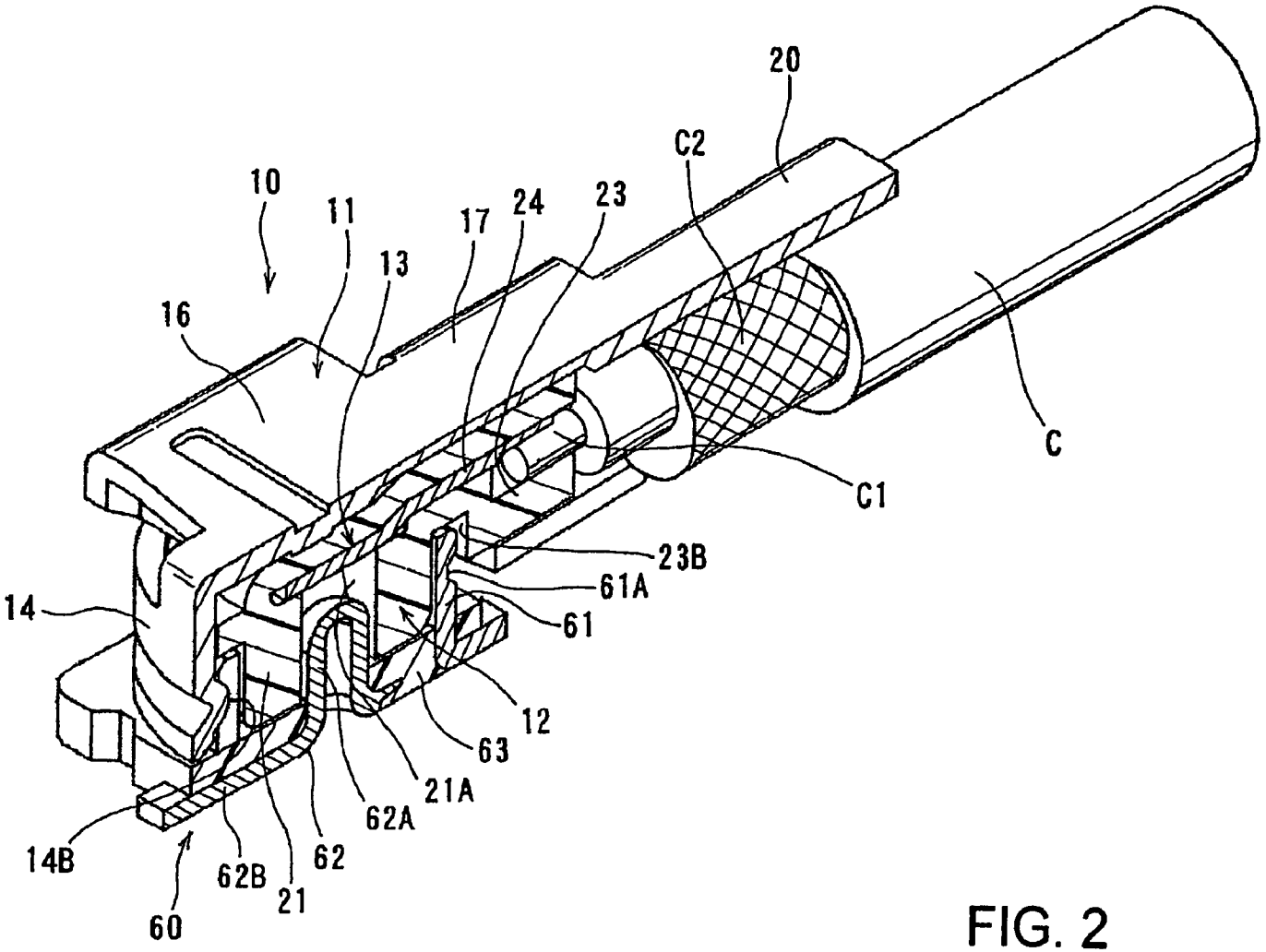
FIG. 2 is a partial cut-away perspective view of the connector when it is connected to the counter connector, in which the cross-section is taken along the same plane as in FIG. 1(A).
Figure 4:
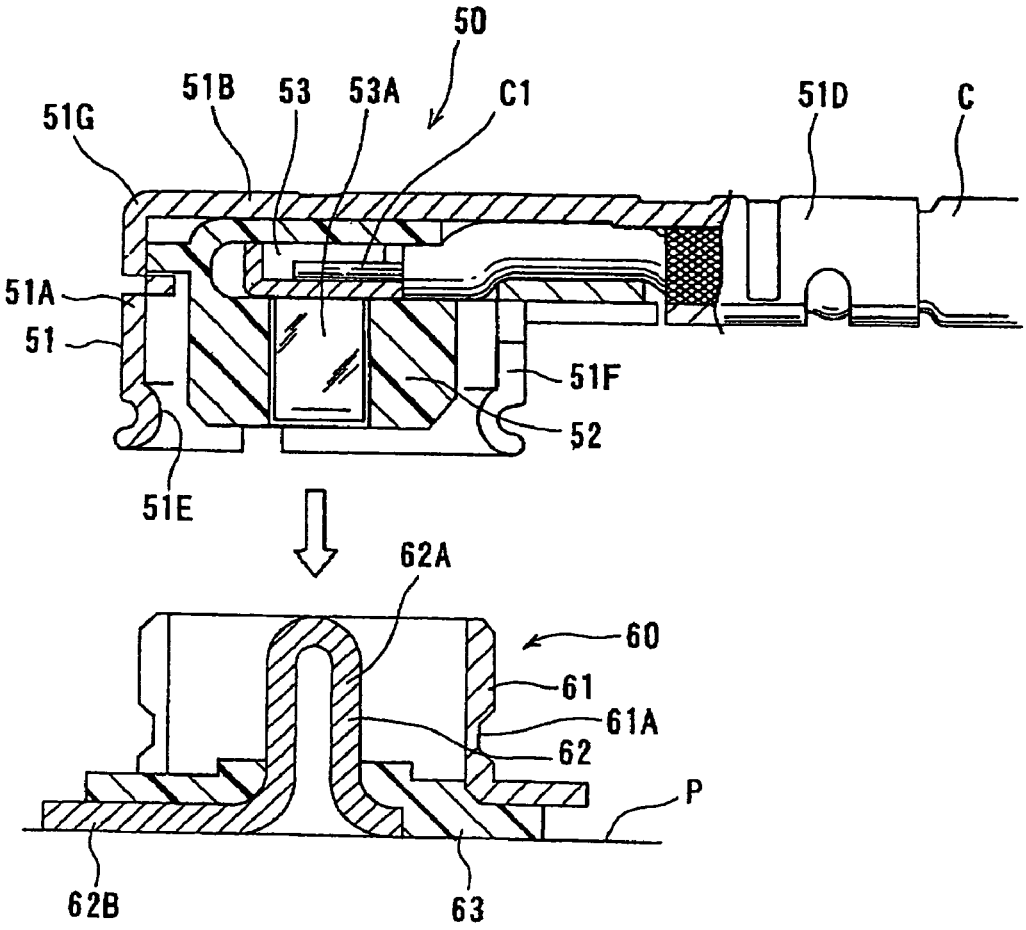
PRIOR ART FIG. 4
FIG. 4 is a cross-sectional view of the conventional connector and the counter connector before they are fitted.
Figure 5:
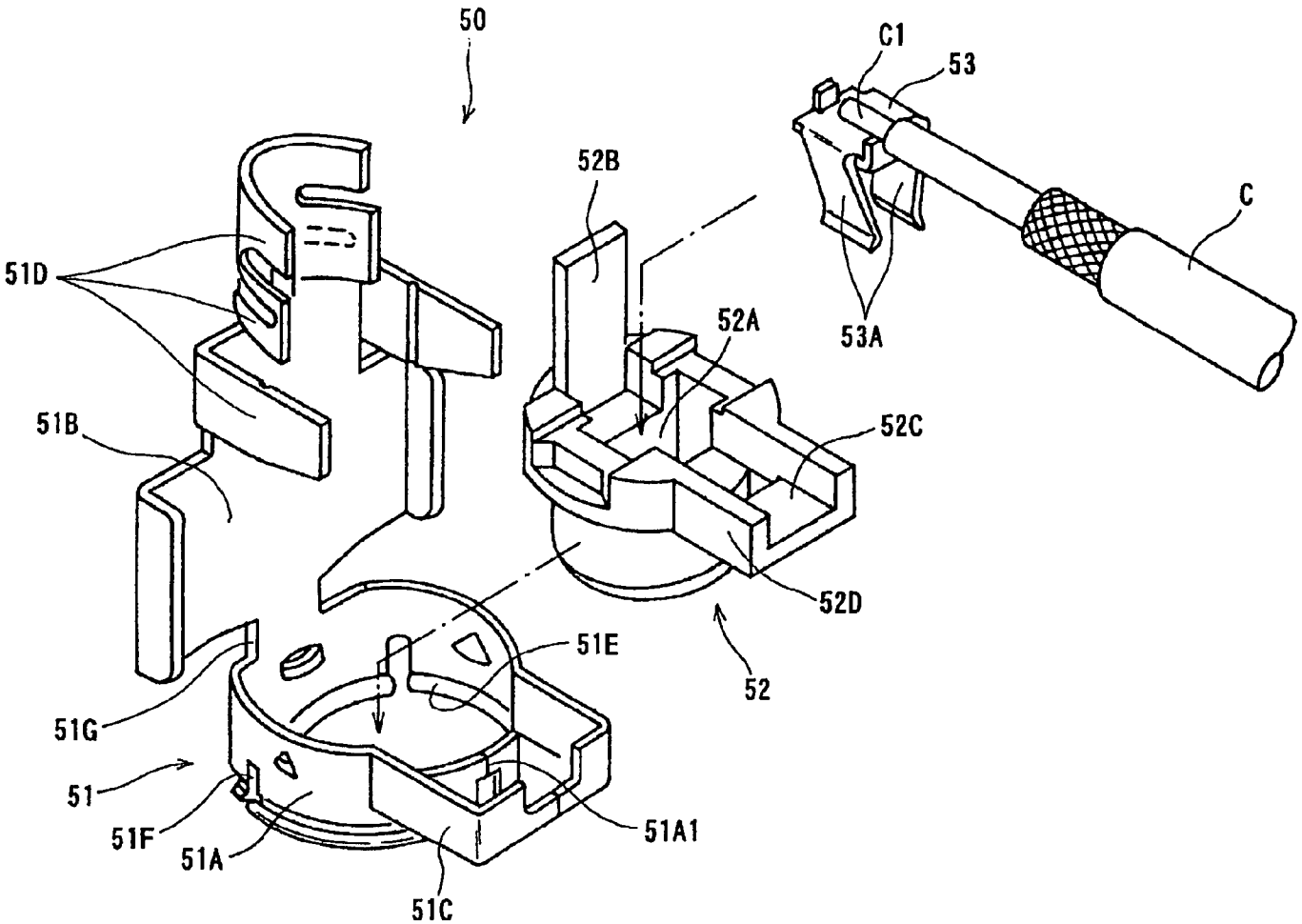
FIG. 5 PRIOR ART
FIG. 5 is an exploded perspective view of the connector of FIG. 4, illustrating the outer conductor, dielectric, and terminal as the center conductor before assembling the connector.

The coaxial connector 10 of this embodiment is connected to the counter connector 60 which is mounted onto a circuit board (See FIG. 2). This counter connector 60 is not a part of this invention, and is same as a conventional connector. Therefore, same reference numerals are used for the same parts as in FIG. 4, and the explanation is omitted. The coaxial connector 10 of this embodiment which is to be connected to the counter connector 60 is so-called "right angle connector", in which the connector fits to the counter connector in the direction perpendicular to the extending direction of the cable and comprises an outer conductor 11, a dielectric 12 and a terminal 13 which is a center conductor.

The outer conductor 11 is formed by first forming the outer shape with a metal sheet and then bending, and has a cylindrical fitting section 14, arms 15, a cover section 16 and a surrounding section 17 as a unitary piece. The cylindrical fitting section 14 is formed by rolling a metal sheet piece so as to form a cylindrical shape, and has an opening 14A on the circumferential wall of the cylindrical fitting section at the cable extending side (FIGS. 1(*c*) and 3). The cylindrical fitting section 14 has a locking section at its lower inner surface, which engages with the annular locking groove formed on the outer surface of the outer conductor 61 of the counter connector 60, and is formed as a generally annular protrusion 14B (FIG. 1(A)).

A pair of flat arms 15 which extend from the opening 14A in the radial direction of the fitting section 14 and are parallel to each other, is formed at the upper half portion of the cylindrical fitting section 14. Narrowing sections 15B, which have smaller distance from each other than the distance between the arms 15, are formed at the boundary portions between the opening 14A and the arms 15. Preferably, the distance between the inner surfaces of the narrowing sections 15B is set as small as the minimum distance required to dispose the connecting section of the terminal that extends in the radial direction and the dielectric that supports the connecting section. In view of the mechanical properties, the distance between the pair of arms is preferably large enough to hold the cable C or the center conductor and so on. In view of the electrical properties, the distance is preferably similar length to the outer diameter of the shielding wire C2 of the cable C. Each narrowing section 15B directly extends from the circumferential wall of the cylindrical fitting section 14. In the height direction, i.e. the axial direction of the cylindrical fitting section 14, the arms 15 has larger width than the narrowing sections 15B so as to extend to the annular protrusion of the cylindrical fitting section 14B and surround the dielectric of the cable C. In other words, the narrowing sections have smaller dimension in the height direction than the arms, so that they can be easily elastically deformed. Latching grooves 15A which are formed like dovetail grooves are formed at the upper edges of the arms, and are opened upward.

The cover section 16 and the surrounding section 17 extend via the linking section 18 from a part of the upper opened end of the cylindrical fitting section, which is a portion on the upper opened end opposite to the opening 14A in the radial direction of the cylindrical fitting section. The surrounding section, the cover section, the linking section and the fitting section are formed together as a unitary piece.

Figure 1A:
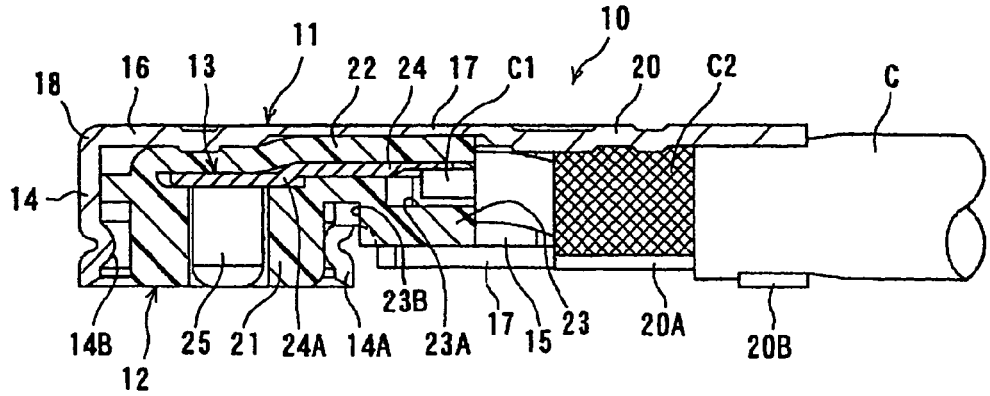
FIG. 1(A) is a cross-sectional view of a coaxial electrical connector according to an embodiment of the invention, taken along the plane of the axis of the cable.

Once the cover section 16 is bent toward the cable C as shown in FIG. 1(A), the upper opened end of the cylindrical fitting section 14 is generally covered. The cover section 16 has shoulders 16A at the side edges, which are bent downward. Once the cover section is bent toward the fitting section, the shoulders 16A are placed outside of the cylindrical fitting section 14.

The outer conductor 11 has the surrounding section which extends from the cover section 16. As shown in FIG. 1(*c*), the surrounding section 17 generally covers the arms in the extending direction of the cable, and forms a rectangular cylindrical shape in the width direction when the surrounding section 17 is bent toward the arms. In this embodiment, when the surrounding section 17 is bent so as to form the rectangular cylindrical shape, it partially covers the narrowing sections at its one end and covers a portion farther than the free ends of the arms at the other end. A space is formed between the narrowing sections 15B and the inner surface of the surrounding section.

A restricting concave section 19 is formed on the inner surface of the cover section 16 and the surrounding section 17. This restrictive concave section 19 is formed thereon by punching without making a protrusion but keeping a flat surface on the outer surface of the cover section 16 and the surrounding section 17. Therefore, the thickness of the restricting concave section 19 is smaller than that of other portions of the cover section and the surrounding section. The restricting concave section 19 is formed to have a rectangular shape having its longitudinal direction along the extending direction of the cable, and houses the tongue of the dielectric, which will be described below, partially in the thickness direction.

A holding section 20 to hold the cable C is provided from the end of the surrounding section opposite the cover section 16. The holding section 20 is formed to form a rectangular cylindrical shape similarly to the surrounding section 17 when it is bent, and comprises a first holding section 20A and a second holding section 20B (See FIG. 3). Those holding sections 20A and 20B have different dimensions in the width direction, so as to be capable of tightly holding the respective cable portions having different thickness. More specifically, the first holding section is designed to tightly hold the cable over the shielding wire (C2), and the second holding section 20B is designed to tightly hold the cable over its outer coating.

The dielectric 12 of the connector 10 is covered and held by the above-described outer conductor 11. The dielectric 12 is made by molding a plastic resin, which is an electric insulating material, and has a main body section 21, a tongue 22 and a cable receiving section 23 as a unitary piece. The lower part of the main body section 21 is shaped so as to be placed in the outer conductor 61 of the counter connector 60, and the upper part of the main body 21 is held by the outer conductor 11.

A hole 21A having a rectangular cylindrical shape is formed at the center part of the main body 21 to receive the contact section of the terminal that will be described below. In addition, the dielectric 12 has the cable receiving section 23 which extends in the extending direction of the cable from the upper portion of the main body 21. Side surfaces of the cable receiving section are formed along the inner surfaces of the arms 15 of the outer conductor 11, and the lower surface of the cable receiving section 23 is formed so as to be along the surrounding section 19 when it is bent to cover the portion. The cable receiving section 23 is designed to have a space in the height direction to receive the connecting section of the terminal, the cable and the tongue 22. In addition, since the dimensions of the connecting section of the terminal and the core-wire C1 of the cable C to be connected to the connecting section are different in the height direction, a step-like section 23A to receive the core-wire C1 is formed partially on the upper surface of the cable receiving section 23. On the lower surface of the cable receiving section 23, a groove 23B, into which the outer conductor 61 of the counter connector can be placed, is formed.

Figure 3:
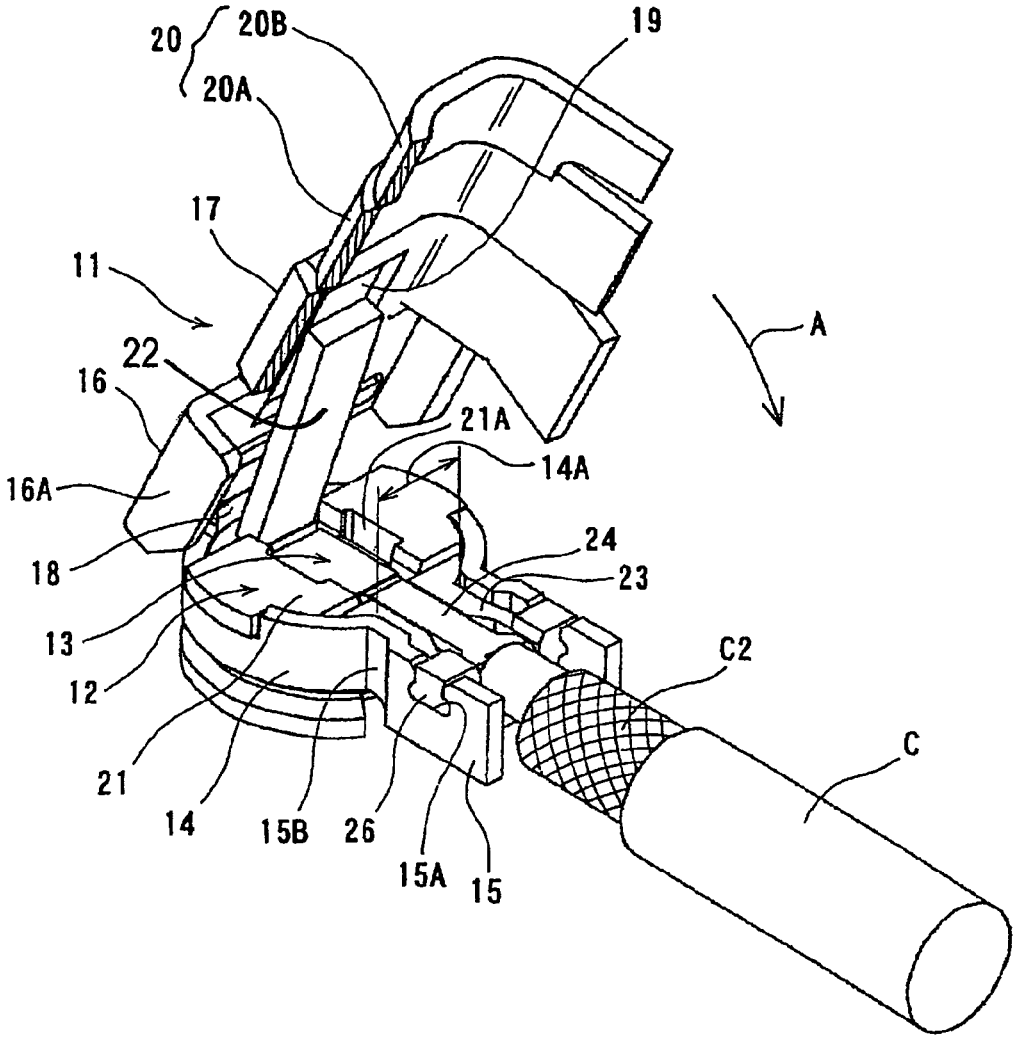
FIG. 3 is a perspective view of the connector of FIG. 1 in the process of assembling.

As shown in FIG. 3, the tongue 22 is formed as a flat piece extending upward being adjacent to the linking section 18 of the outer conductor 11. The tongue 22 has a width suitable to be housed in the restricting concave section 19 formed on the inner surface of the cover section 16 and the surrounding section 17 of the outer conductor 11. When the cover section 16 is also bent at the linking section 18, the tongue 22 is bent with the cover section being pushed by the cover section 16, and housed in the restricting concave section 19. In addition, the dielectric 12 has latching protrusions 26 which engage with the latching grooves 15A being pressed from their upper sides into the latching groove formed on the arms 15 of the outer conductor 11.

Figure 1B:
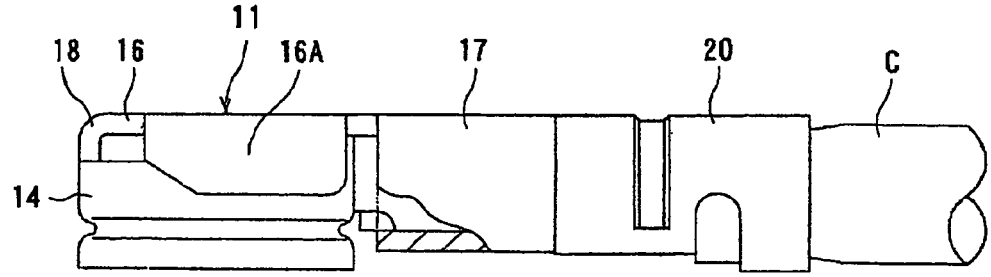
FIG. 1(B) is a side view of the coaxial electrical connector.
Figure 1C:
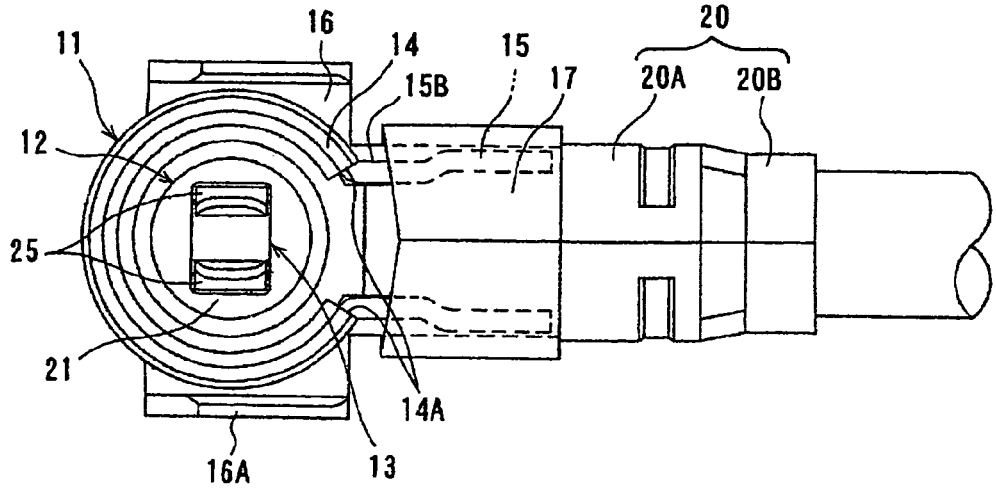
FIG. 1(C) is a bottom view of the coaxial electrical connector.

As shown in FIG. 1, the terminal 13 has a connecting section 24 which is generally flat and extends along the extending direction of the cable C, and has a pair of flat contact sections 25 which extend downward along the fitting direction of the connectors from the connecting section 24. The connecting section 24 extend almost near the end of the tongue 22 after bent, and tightly held between the tongue 22 and the upper surface of the main body 21 of the dielectric 12. The connecting section 24 has a thinner portion, which is formed by punching, on the lower surface of its end where the connecting section is connected to the core-wire of the cable C. The connecting section 24 also has a small part of angled section 24A at the middle part of the terminal, corresponding to the step-like section of the main body 21 of the dielectric 12 (See FIG. 1(A)). The distance between the pair of the contact sections 25 is set to tightly press the rod-like contact section 62A of the center conductor 62 of the counter connector 60.

The procedure for assembling and how to use the above-described connector are described below.

(1) First, the core-wire C1 of the cable C, which is exposed at the end by removal of the outer coating and so on, is connected by soldering to the connecting section 24 of the terminal 13. This connection by soldering is done at the lower surface of end portion of the connecting section, which is dented and has a smaller thickness.

(2) Next, after or before the connection described in (1), the dielectric 12 is placed onto the outer conductor 11. More specifically, the main body 21 and the cable receiving section 22 of the dielectric 12 are placed in the cylindrical fitting section 14 and between the pair of arms, respectively. The latching protrusions 26 formed on the side surfaces of the cable receiving section 22 are pressed in the latching grooves 15A. At this time, the tongue 22 of the dielectric 12 and the cover section 16 of the outer conductor 11 are not bent yet, therefore still extend upward.

(3) Thereafter, the contact section 25 of the terminal 13 is inserted and arranged in the hole 21A formed on the main body of the dielectric 12. This arrangement of the contact section 25 into the hole 21A can be done outside the outer conductor 11 before placing the dielectric onto the outer conductor 11. At this time, the core-wire C1 of the cable can be soldered to the connecting section 24.

(4) Next, as shown in FIG. 3, the cover section 16 and the surrounding section 17 of the outer conductor 11 are bent at the linking section in the direction of the arrow A, so as to be bent toward the cable C. At the time of bending, the tongue 22 of the dielectric 12 is placed in the restricting concave section 19, which is formed on the inner surface of the cover section 16 and the surrounding section 17 of the outer conductor 11. Therefore, the movement of the tongue in the width direction is restricted but it slides on the bottom surface of the restricting concave section in the longitudinal direction.

(5) Once the cover section 16 and the surrounding section 17 are completely folded by bending at the linking section 18, the cover section 16 covers the upper portion of the cylindrical fitting section 14 of the outer conductor 11, and the surrounding section 17 covers the cable C held in the cable receiving section 23, and the holding section 20 contacts with the cable. In addition, the cover section 16 and the surrounding section 17 hold the terminal via the tongue 22.

Thereafter, the surrounding section 17, the first holding section 20A and the second holding section 20B are bent so as to surround the cable and the other portions. The surrounding section 17 securely surrounds and holds the arms 15, the cable receiving section 22 of the dielectric 12 disposed between the arms 15, the end of the tongue 22, and the connecting section 24 of the terminal together. The first holding section 20A and the second holding section 20B tightly hold the cable C over the shielding wire portion C2 and over the outer coating, respectively.

(7) As shown in FIG. 2, the connector assembled as described above is fitted and connected to the counter connector 60. By fitting those connectors, the terminal 13 of the center conductor of the connector 10 elastically contacts with the contact section 62A of the center conductor 62 of the counter connector 60 at its contact section 14. In addition, the outer conductor 61 of the counter connector 61 is placed in the annular space between the cylindrical fitting section 14 of the outer conductor 11 and the dielectric 12 of the connector 10. The diameter of the annular protrusion 14B provided on the inner surface of the outer conductor 11 is enlarged by contacting with the upper edge of the outer conductor 61 of the counter connector 60, so that the connector 10 can be fitted to the counter connector 60. The diameter of the outer conductor 11 is elastically enlarged mainly around the narrowing sections 15B of the cylindrical fitting section 14, enlarging the distance between the narrowing sections 15B. Since the narrowing sections are provided being a certain distance away from each other, the enlargement of the outer conductor 11 which is required for the fitting of the connectors can be achieved without dramatically enlarging the distance between the narrowing sections. Accordingly, the circular shape of the cylindrical fitting section 14 will not be deformed so much. Therefore, the elasticity for required enlargement of the diameter of the cylindrical fitting section 14 can be easily achieved and the rigidity for maintaining the shape is secured. After the elastic deformation, the annular protrusion 14B of the cylindrical fitting section 14 engages with the locking groove 61A of the counter connector 60.

It should be understood that the present invention is not limited by the embodiment illustrated in the drawings, and can be altered or modified within its scope. In the embodiment, the elasticity for enlarging the diameter of the cylindrical fitting section is achieved by the narrowing sections, but in order to achieve even larger elasticity, for example, a slit similar to the conventional one can be formed. In addition, the surrounding section can directly hold the cable over the outer coating.

What is claimed is:

1. A coaxial electrical connector, comprising:

an outer conductor which is comprised of:

a cylindrical fitting section, which has an axis along a fitting direction of said connector to a counter connector and has an opened end for fitting said connector to said counter connector, said cylindrical fitting section having end portions being spaced and opposite from each other;

a cover section to cover the other opened end of said cylindrical fitting section;

a pair of arms that extends from said cylindrical fitting section in a lateral direction of said cylindrical fitting section, and has narrowing sections integrally formed with said end portions at the boundary portions between said arms and said cylindrical fitting section;

a surrounding section to surround said arms and a cable, which extends in said lateral direction of said cylindrical fitting section; and a linking section which is provided between said cylindrical fitting section and said cover section;

a dielectric which is placed in said cylindrical fitting section; and a center conductor which is held by said dielectric and has a contact section that extends in said axial direction and a connecting section connected to said cable, wherein said cover section and said surrounding section are formed by bending at said linking section a portion extending along said axial direction from said other opened end of said cylindrical fitting section;

wherein said dielectric comprises:

a cable receiving section which extends in the radial direction of said cylindrical fitting section and is disposed between said pair of arms; and a latching protrusion which fastens said cable receiving section and said arms to each other.

2. The coaxial electrical connector according to claim 1, said surrounding section extends in an extending direction of said cable so as to partially cover said narrowing sections.

3. The coaxial electrical connector according to claim 1, wherein said narrowing sections are formed so as to extend from said arms toward a circumferential wall of said cylindrical fitting section.

4. The coaxial electrical connector according to claim 1, wherein said cylindrical fitting section has a slit which crosses said locking section and is opened at one end of said cylindrical fitting section.

5. A coaxial electrical connector comprising:

a cylindrical fitting section, which has an axis along a fitting direction of said connector to a counter connector and has an opened end for fitting said connector to said counter connector, said cylindrical fitting section having end portions being spaced and opposite from each other;

a cover section to cover the other opened end of said cylindrical fitting section;

a pair of arms that extends from said cylindrical fitting section in a lateral direction of said cylindrical fitting section, and has narrowing sections integrally formed with said end portions at the boundary portions between said arms and said cylindrical fitting section;

a surrounding section to surround said arms and a cable; and a linking section which is provided between said cylindrical fitting section and said cover section;

a dielectric which is placed in said cylindrical fitting section; and a center conductor which is held by said dielectric and has a contact section that extends in said axial direction and a connection section connected to said cable, wherein said cylindrical fitting section has a height as substantially equal to a height of said arms and a locking section on an inner surface in order to lock the fitting of said connector to said counter connecter;

wherein said dielectric comprises:

a cable receiving section which extends in the radial direction of said cylindrical fitting section and is disposed between said pair of arms; and a latching protrusion which fastens said cable receiving section and said arms to each other.

6. The coaxial electrical connector according to claim 5, wherein said locking section of said cylindrical fitting section is formed along a circumferential direction to said arms as an annular protrusion.

7. The coaxial electrical connector according to claim 6, wherein said cylindrical fitting section has a slit which crosses said locking section and is opened at one end of said cylindrical fitting section.

8. The coaxial electrical connector according to claim 5, wherein said cylindrical fitting section has a slit which crosses said locking section and is opened at one end of said cylindrical fitting section.

* * * * *